US006185966B1

(12) United States Patent
Chen

(10) Patent No.: US 6,185,966 B1
(45) Date of Patent: Feb. 13, 2001

(54) LOCK APPARATUS

(76) Inventor: Waterson Chen, 8F, No.428, Wu-Chuan-Nan Rd., Taichung City (TW)

( * ) Notice: Under 35 U.S.C. 154(b), the term of this patent shall be extended for 0 days.

(21) Appl. No.: 09/361,890

(22) Filed: Jul. 27, 1999

(51) Int. Cl.[7] ..... E05B 17/04; E05B 29/02
(52) U.S. Cl. ..... 70/366; 70/379 R; 70/417
(58) Field of Search ..... 70/365, 366, 417, 70/379 R, 379 A, 380

(56) References Cited

U.S. PATENT DOCUMENTS

| | | | | |
|---|---|---|---|---|
| 1,674,513 | * | 6/1928 | Jacobi | 70/380 |
| 3,795,123 | * | 3/1974 | Stiffel | 70/417 |
| 4,062,211 | * | 12/1977 | Miller et al. | 70/417 X |
| 4,074,552 | * | 2/1978 | Smith | 70/417 |
| 4,083,212 | * | 4/1978 | Proefrock | 70/366 |
| 4,903,512 | * | 2/1990 | Leroy et al. | 70/380 X |
| 5,345,794 | * | 9/1994 | Jenks | 70/370 X |
| 5,732,580 | * | 3/1998 | Garnault et al. | 70/379 R |
| 5,934,121 | * | 8/1999 | Cheu | 70/366 X |
| 6,012,311 | * | 1/2000 | Duckwall | 70/369 |

FOREIGN PATENT DOCUMENTS

| | | | | |
|---|---|---|---|---|
| 2009677 | * | 10/1970 | (DE) | 70/379 R |
| 2557151 | * | 7/1976 | (DE) | 70/417 |
| 2556031 | * | 6/1985 | (FR) | 70/380 |
| 1196417 | * | 6/1970 | (GB) | 70/365 |
| 2129045 | * | 5/1984 | (GB) | 70/365 |
| 2210660 | * | 6/1989 | (GB) | 70/366 |
| WO83/00178 | * | 1/1983 | (WO) | 70/417 |

* cited by examiner

*Primary Examiner*—Lloyd A. Gall
(74) *Attorney, Agent, or Firm*—Rodman & Rodman

(57) ABSTRACT

A lock apparatus includes a lock shell that defines a lock core receiving space between front and rear end portions thereof. A cylindrical inner shell is received rotatably in the core receiving space, and has a front chamber and a rear chamber. A stack of annular locking plates are disposed rotatably in the front chamber of the inner shell. The locking plates have central holes which cooperatively define an axial key hole of the lock core unit. An annular drive plate is disposed in the front chamber, and has a key passage hole registered with the central hole of the locking plates, and a radial outward drive member that is bent to extend axially into the rear chamber. A latch actuator has a connecting portion inserted into the core receiving space and into the rear chamber to couple with the inner shell for co-rotation therewith. The connecting portion has a front end face in a transverse direction relative to the key hole, a tubular wall extending from the front end face toward the front chamber and confining a key insert hole that is registered with the central holes of the locking plates and the key passage hole of the drive plate, and a radially and outwardly extending cam projection with two planar surfaces to define an arc groove for receiving the drive member.

7 Claims, 7 Drawing Sheets

LOCK APPARATUS

FIELD OF THE INVENTION

The invention relates to a lock apparatus, more particularly to a lock apparatus which has a relatively long service life, and which can provide a good anti-theft effect.

BACKGROUND OF THE INVENTION

In co-pending U.S. patent application Ser. No. 08/992,443, filed by the applicant on Dec. 17, 1997, there is disclosed a lock apparatus including a lock shell, a cylindrical lock core unit received in the lock shell and having an axial key hole and being provided with a latch actuator, and a coded key. The coded key is extendible into the key hole of the lock core unit, and is operable so as to permit rotation of the lock core unit relative to the lock shell for moving the latch actuator from a locking position to an unlocking position.

The key has a head portion and a shank portion that extends from the head portion. The shank portion has a cross-section in the form of a circular section with first and second planar surfaces that extend along length of the shank portion, and a curved sector that interconnects the first and second planar surfaces and that has an arc length greater than 180 degrees. The shank portion is formed with a plurality of key bit projections and key bit grooves on one of the first and second planar surfaces. The key bit projections and the key bit grooves have inclined actuating surfaces that form different angles with the first and second planar surfaces to set code of the key.

The lock shell is formed with an axially extending locking groove. The lock core unit includes a cylindrical inner shell disposed in the lock shell, and is formed with an axially extending locking slot that is registered with the locking groove when the lock core unit is in the locking position, and a stack of annular locking plates. Each of the locking plates has an inner periphery that confines a central hole. The central holes of the locking plates define cooperatively the key hole of the lock core unit. Each of the locking plates further has an outer periphery that is formed with an engaging notch. The engaging notches of the locking plates are misaligned with one another in accordance with the code of the key when the lock core unit is in the locking position, and are aligned with one another when the lock core unit is in the unlocking position. The inner periphery of each of the locking plates is formed with a radial inward key engaging protrusion. The key engaging protrusion has a first radial edge to abut against the actuating surface of a corresponding one of the key bit projection and the key bit grooves on the key when the key is received in the key hole and is rotated to unlock the lock core unit, thereby permitting rotation of the locking plates by different angles corresponding to the angles of the actuating surfaces of the key bit projections and the key bit grooves on the key in order to align the engaging notches on the locking plates.

The key engaging protrusion further has a second radial edge opposite to the first radial edge to abut against the other one of the first and second planar surfaces of the shank portion of the key when the key is received in the key hole and is rotated to lock the lock core unit, thereby permitting rotation of the locking plates in order to misalign the engaging notches on the locking plates according to the code of the key.

A locking rod is received in the locking slot of the inner shell. Misalignment of the engaging notches on the locking plate enables the outer peripheries of the locking plates to force the locking rod to extend into the locking groove of the lock shell in order to prevent rotation of the inner shell relative to the lock shell when the lock core unit is in the locking position. Alignment of the engaging notches on the locking plates enables the locking rod to disengage the locking groove and to engage the engaging notches in order to permit rotation of the inner shell relative to the lock shell when the lock core unit is in the unlocking position.

The lock core unit further includes an annular drive plate disposed in the inner shell between the latch actuator and the locking plates. The drive plate has a key engaging inner periphery and an outer periphery formed with a radial cam projection. The inner periphery of the drive plate engages the shank portion of the key when the key is received in the key hole for co-rotation therewith. The latch actuator has a cam actuatable section which is driven by the radial cam projection of the drive plate such that rotation of the drive plate can result in corresponding rotation of the latch actuator between the locking and unlocking positions.

Some of the disadvantages of the aforesaid lock apparatus are as follows:

(a) The radial cam projection of the drive plate is shaped as a circular sector less than half of a circle in arc length and defines two radial cam edges, thereby defining in cooperation with the inner shell an arc groove between the radial cam edges such that the drive plate may wobble in a radial direction relative to the inner shell to result in misalignment of the key engaging inner periphery of the drive plate with respect to the radial inward key engaging protrusions of the locking plates, thereby hindering smooth insertion of the correct key into the lock core unit for actuating the latch actuator from the locking position to the unlocking position.

(b) The front end of the lock shell is not provided any anti-theft means in order to prevent a picking tool, such as a drill, from reaching an interior of the lock shell and hence the lock core unit.

SUMMARY OF THE INVENTION

The main object of this invention is to provide a lock apparatus which has a lock shell provided with anti-theft means at the front end thereof to prevent picking of the same, and a lock core unit with a plurality of locking plates adapted to be inserted smoothly by a correct key.

Accordingly, the lock apparatus of the present invention includes a lock shell and a cylindrical lock core unit. The lock shell has front and rear end portions and a cylindrical lock core receiving space extending through the front and rear end portions. The lock core unit includes a cylindrical inner shell received rotatably in the receiving space of the lock shell. The inner shell has a front chamber and a rear chamber. A stack of annular locking plates are disposed rotatably in the front chamber of the inner shell. Each of the locking plates has an inner periphery that confines a central hole. The central holes of the locking plates define cooperatively an axial key hole of the lock core unit. An annular drive plate is disposed in the front chamber between the locking plates and the rear chamber of the inner shell. The drive plate has an inner periphery that confines a key passage hole registered with the central hole of the locking plates, and an outer periphery formed with a radial outward drive member that is bent to extend axially into the rear chamber. A latch actuator has a connecting portion inserted into the receiving space via the rear end portion of the lock shell and further extends into the rear chamber of the inner shell, and an actuating portion that extends from the connecting portion out of the rear chamber. The connecting portion is coupled with the inner shell for co-rotation therewith. The connecting portion has a front end face extending in a transverse direction relative to the key hole, a tubular wall extending from the front end face in a direction toward the front chamber and confining a key insert hole that is registered with the central holes of the locking plates and the key passage hole of the drive plate, and a cam projection extending radially and outwardly from the tubular wall. The cam projection is formed with two planar surfaces at two radial sides of the key insert hole. The front end face, the tubular wall and the planar surfaces of the cam projection cooperatively define an arc groove. The drive member of the drive plate extends into the arc groove in such a manner that rotation of the drive plate together with the locking plates upon insertion of a correct key into the key hole and the key passage hole will result in movement of the drive member in the arc groove and in abutment of the drive member with one of the planar surfaces to move the latch actuator together with the inner shell between the locking and unlocking positions relative to the lock shell.

Preferably, a mounting block is mounted on the front end portion of the lock shell. The mounting block is formed with a central access hole that is registered with the key hole of the lock core unit. A rotary cover member is mounted on the mounting block, and is fully rotatable in the access hole about axis of the key hole. The rotary cover member is formed with a central hole that is registered with the key hole of the lock core unit.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
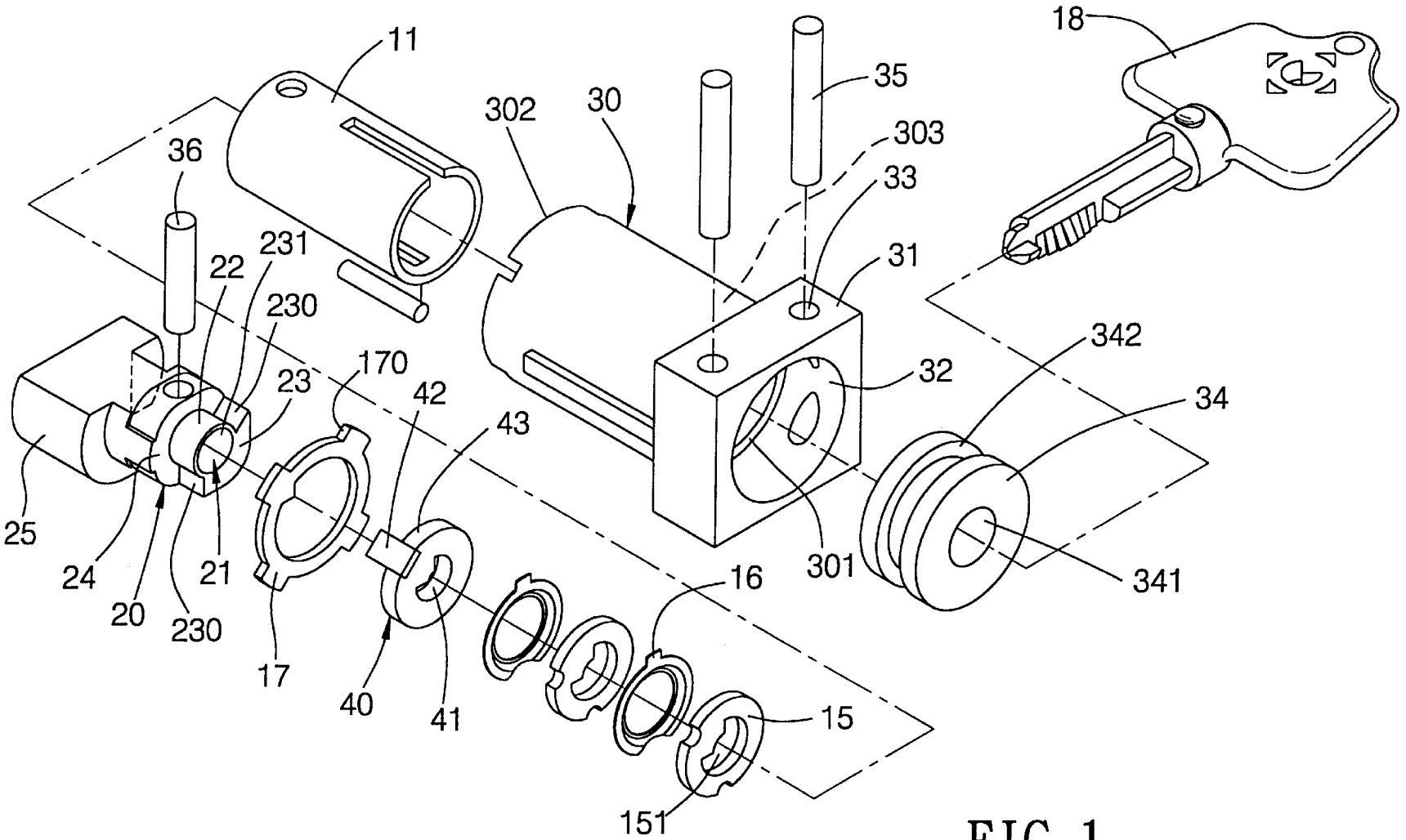
FIG. 1 is an exploded view of the first preferred embodiment of a lock apparatus of the present invention.
Figure 2:
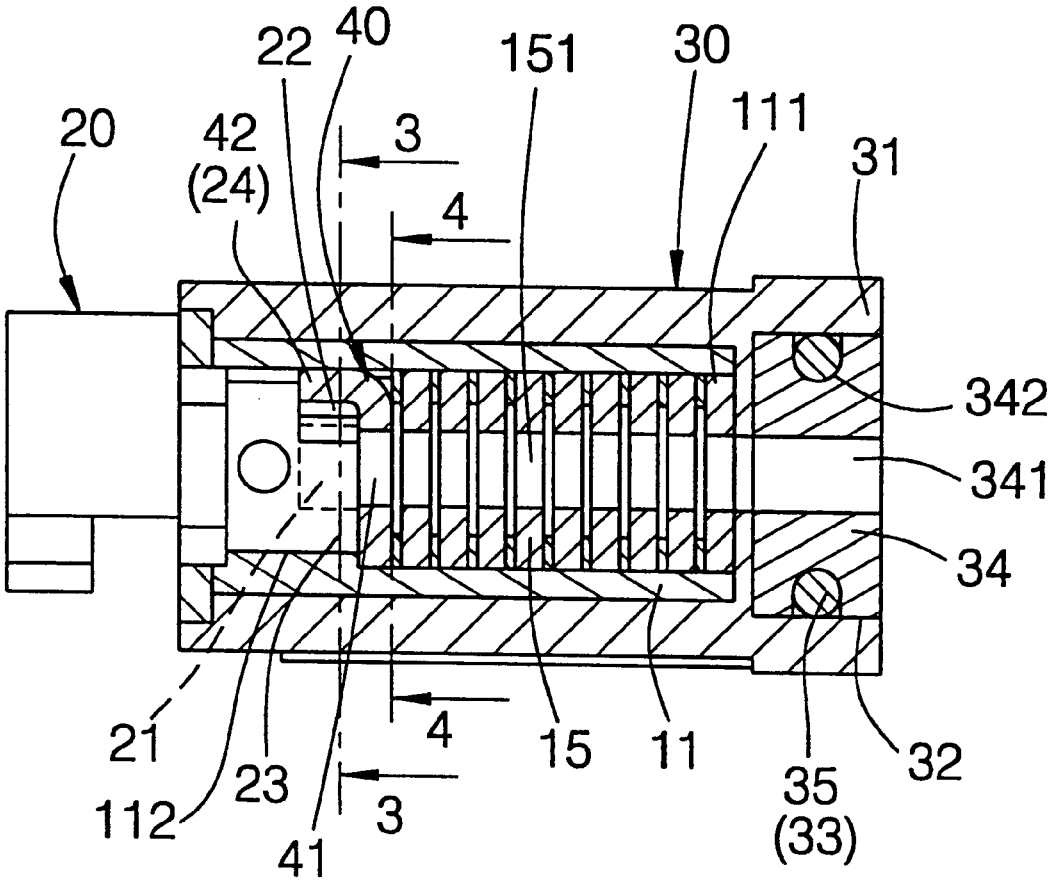
FIG. 2 is a sectional view of the first preferred embodiment.
Figure 3:
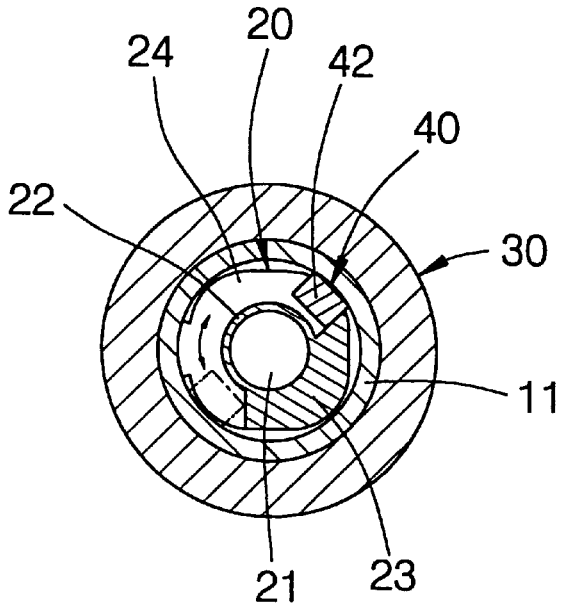
FIG. 3 is a cross-sectional view of the first preferred embodiment taken along lines 3—3 of FIG. 2.
Figure 4:
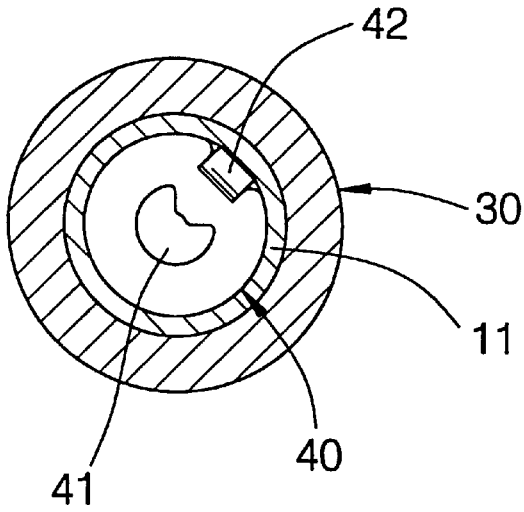
FIG. 4 is a cross-sectional view of the first preferred embodiment taken along lines 4—4 of FIG. 2.

Referring to FIGS. 1 and 2, the lock apparatus of the first preferred embodiment of the present invention is shown to comprise a coded key 18, and a lock device which includes a lock shell 30 and a lock core unit.

As illustrated, the lock shell 30 has front and rear end portions 301,302 and a cylindrical lock core receiving space 303 that extends through the front and rear end portions 301,302.

The lock core unit includes a cylindrical inner shell 11, a stack of locking plates 15, a stack of spacer plates 16, an annular drive plate 40, a retention plate 17 and a latch actuator 20. The inner shell 11 is received rotatably in the receiving space 303 of the lock shell 30, and has a front chamber 111 and a rear chamber 112.

The locking plates 15 are disposed rotatably in the front chamber 111 of the inner shell 11. Each of the locking plates 15 has an inner periphery that confines a central hole 151. The central holes 151 of the locking plates 15 define cooperatively an axial key hole of the lock core unit.

The drive plate 40 is disposed in the front chamber 111 between the locking plates 15 and the rear chamber 112 of the inner shell 11. The drive plate 40 has an inner periphery that confines a key passage hole 41 registered with the central holes 151 of the locking plates 15, and an outer periphery 43 formed with a radial outward drive member 42 that is bent to extend axially into the rear chamber 112 of the inner shell 11.

Each of the spacer plates 16 is disposed between adjacent two of the locking plates 15.

The latch actuator 20 has a connecting portion 21 inserted into the receiving space 303 of the lock shell 30 via the rear end portion 302 and further extends into the rear chamber 112 of the inner shell 11, and an actuating portion 25 that extends from the connecting portion 21 out of the rear chamber 112 of the inner shell 11. The connecting portion 21 is coupled with the inner shell 11 by a locking pin 36 for co-rotation therewith. The connecting portion 21 has a front end face 24 extending in a transverse direction relative to the key hole, a tubular wall 22 extending from the front end face 24 in a direction toward the front chamber 111 of the inner shell 11 and confining a key insert hole 231 that is registered with the central holes 151 of the locking plates 15 and the key passage hole 41 of the drive plate 40, and a cam projection 23 extending radially and outwardly from the tubular wall 22. The cam projection 23 is formed with two planar surfaces 230 at two radial sides of the key insert hole 231. The front end face 24, the tubular wall 22, the planar surfaces 230 of the cam projection 23 and the inner shell 11 cooperatively define an arc groove. The drive member 42 of the drive plate 40 extends into the arc groove in such a manner that rotation of the drive plate 40 together with the locking plates 15 upon insertion of a correct key into the key hole and the key passage hole 41 will result in movement of the drive member 42 in the arc groove and in abutment of the drive member 42 with one of the planar surfaces 230 to move the latch actuator 20 together with the inner shell 11 between the locking and unlocking positions relative to the lock shell 30.

The retention plate 17 is sleeved around the connecting portion 21 of the latch actuator 20, and has four radially and outwardly extending ribs 170 engaged securely to the rear end portion 302 of the lock shell 30 in order to prevent axial disengagement of the inner shell 11 relative to the lock shell 30.

The first preferred embodiment further includes a mounting block 31 mounted on the front end portion 301 of the lock shell 30. The mounting block 31 is formed with a central access hole 32 that is registered with the key hole of the core unit. A rotary cover member 34 is mounted on the mounting block 31. The rotary cover member 34 is fully rotatable in the access hole 32 of the mounting block 31 about axis of the key hole and is formed with a central hole 341 that is registered with the key hole. The rotary cover member 34 has a circular outer periphery that is formed with an annular retention groove 342 therealong. The mounting block 31 has two retention pins 35 that extend through chordally into the retention groove 342 such that the rotary cover member 34 is retained in the access hole 32 of the mounting block 31 and is thus prevented from axial movement in the access hole 32. Under such a condition, the rotary cover member 34 is fully rotatable relative to the mounting block 31. In order to withstand a drilling action, the rotary cover member 34 is preferably made from a high strength metal alloy. Preferably, the mounting block 3L is integrally formed with the front end portion 301 of the lock shell 30.

As the specific structures of the spacer plates 16 and the locking plates 15 in relation to the coded key 18, and how the inner shell 11 engages and disengages the lock shell 30 during the locking and unlocking movement can be done in a manner similar to that of the aforesaid co-pending application and are thus not pertinent to the present invention, a detailed description thereof is omitted herein for the same of brevity.

When a drill works on the rotary cover member 34, the cover member 34 will rotate idly relative to the mounting block 31, thereby preventing the drill from reaching the interior of the lock apparatus.

Another aspect to note is that since the key passage hole 41 of the drive plate 40, and the central holes 151 of the locking plates 15 are in alignment with one another, insertion of the correct key 18 into the key hole of the lock core unit is facilitated in the present invention.

Figure 5:
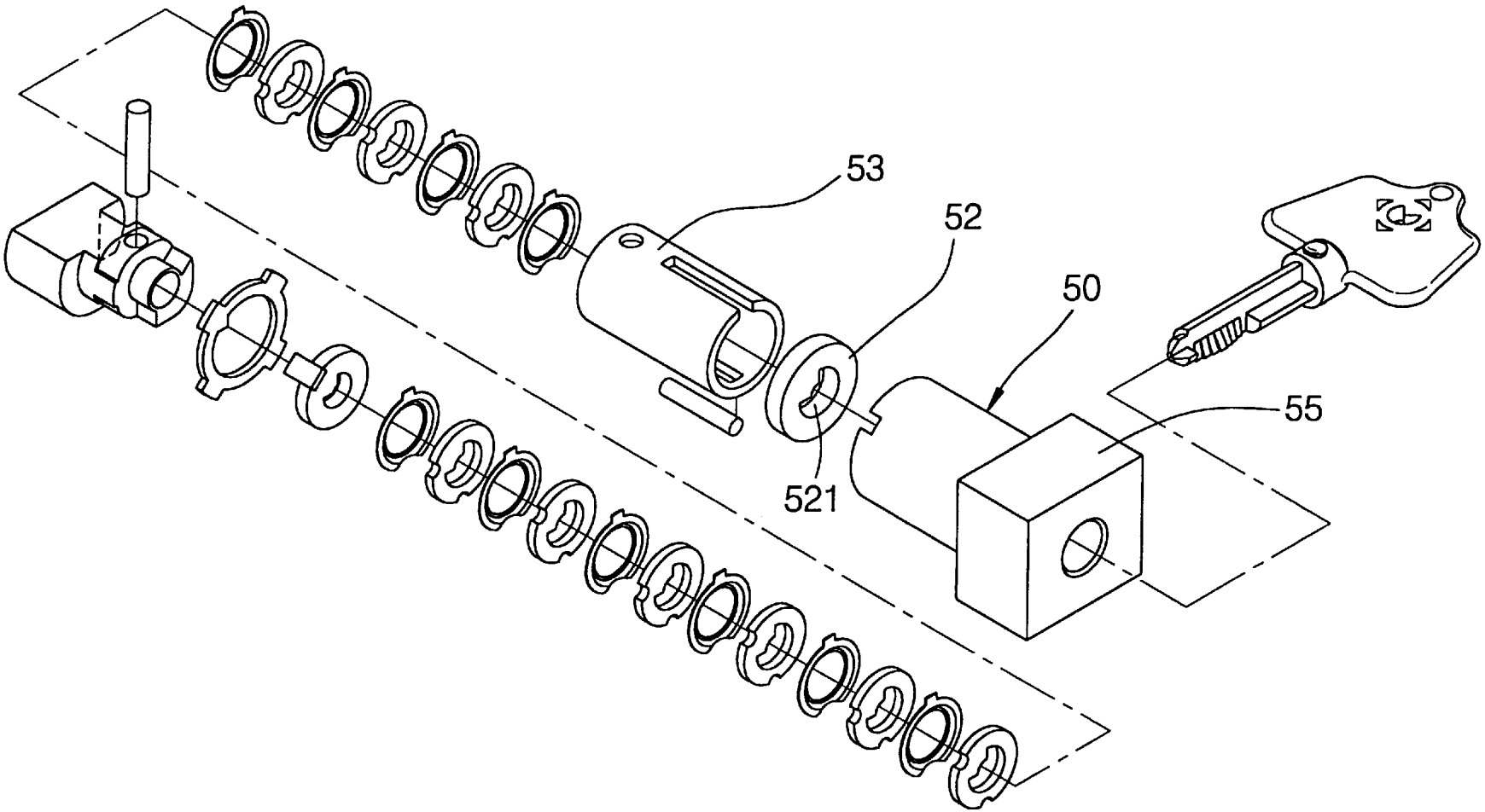
FIG. 5 is an exploded view of the second preferred embodiment of a lock apparatus of the present invention.
Figure 6:
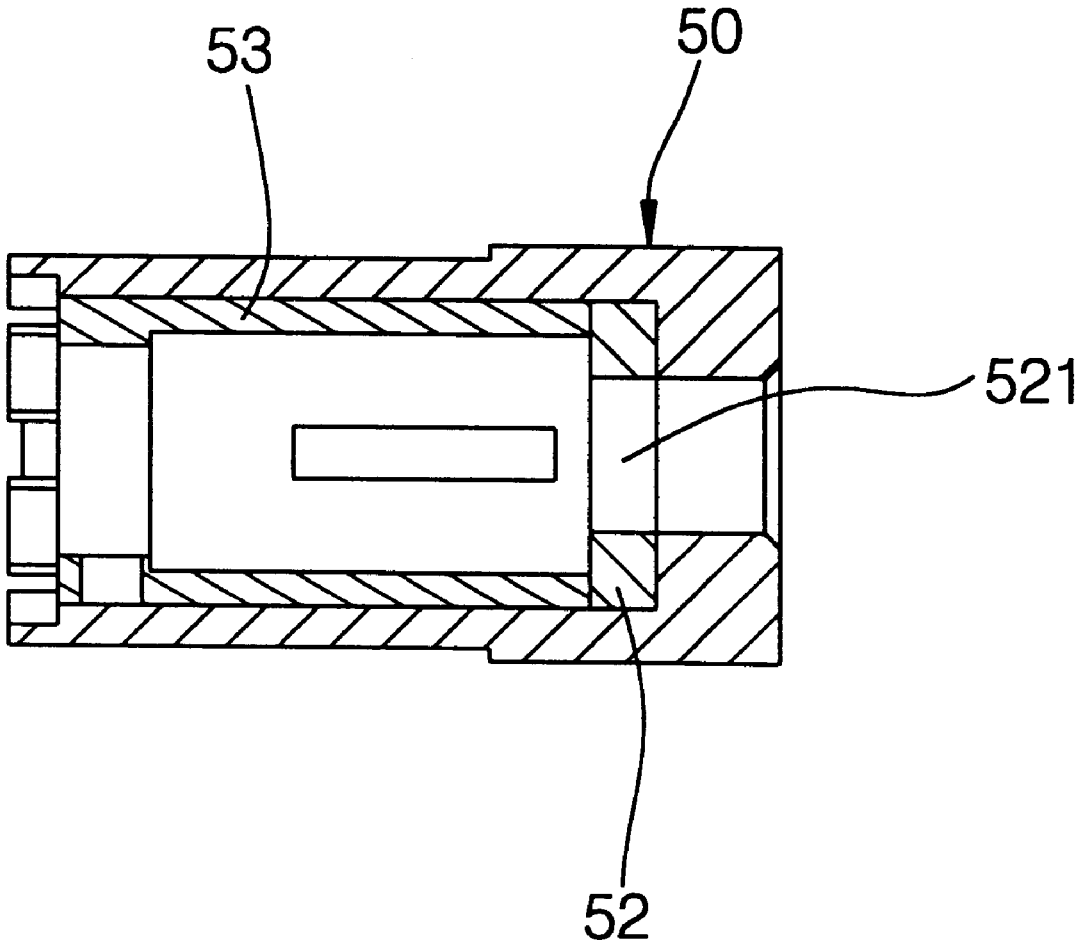
FIG. 6 is a sectional view of the second preferred embodiment, wherein the latch actuator, the retention plate, the drive plate, and the locking plates are removed for the sake of clarity.

Referring to FIGS. 5 and 6, the second preferred embodiment of the present invention is shown to be similar to the first embodiment except in that the rotary cover member 52 is received in the lock shell 50 between the mounting block 55 and the inner shell 53. The rotary cover member 52 defines a central hole 521 that is registered with the key hole of the lock core unit.

Figure 7:
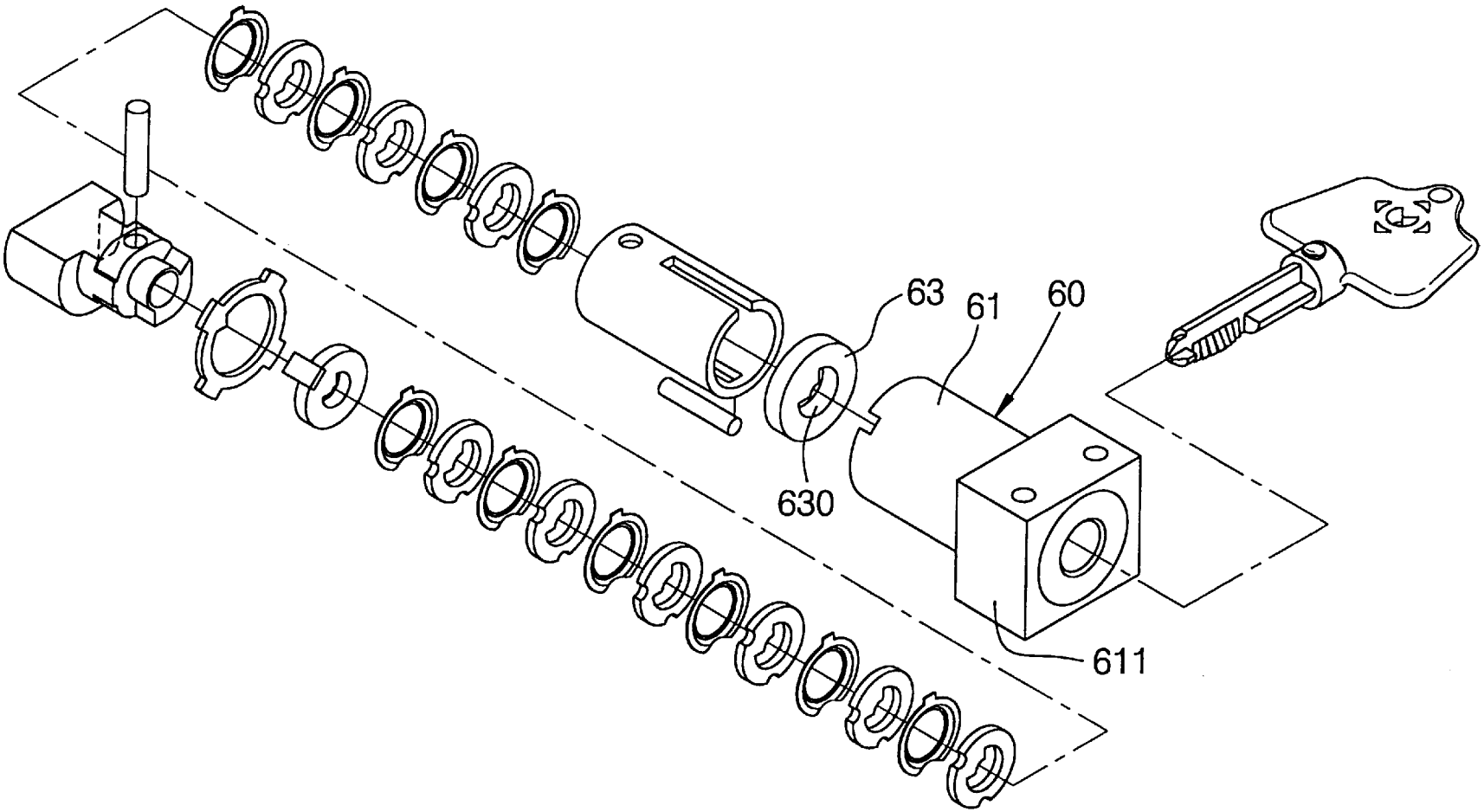
FIG. 7 is an exploded view of the third preferred embodiment of a lock apparatus of the present invention.
Figure 8:
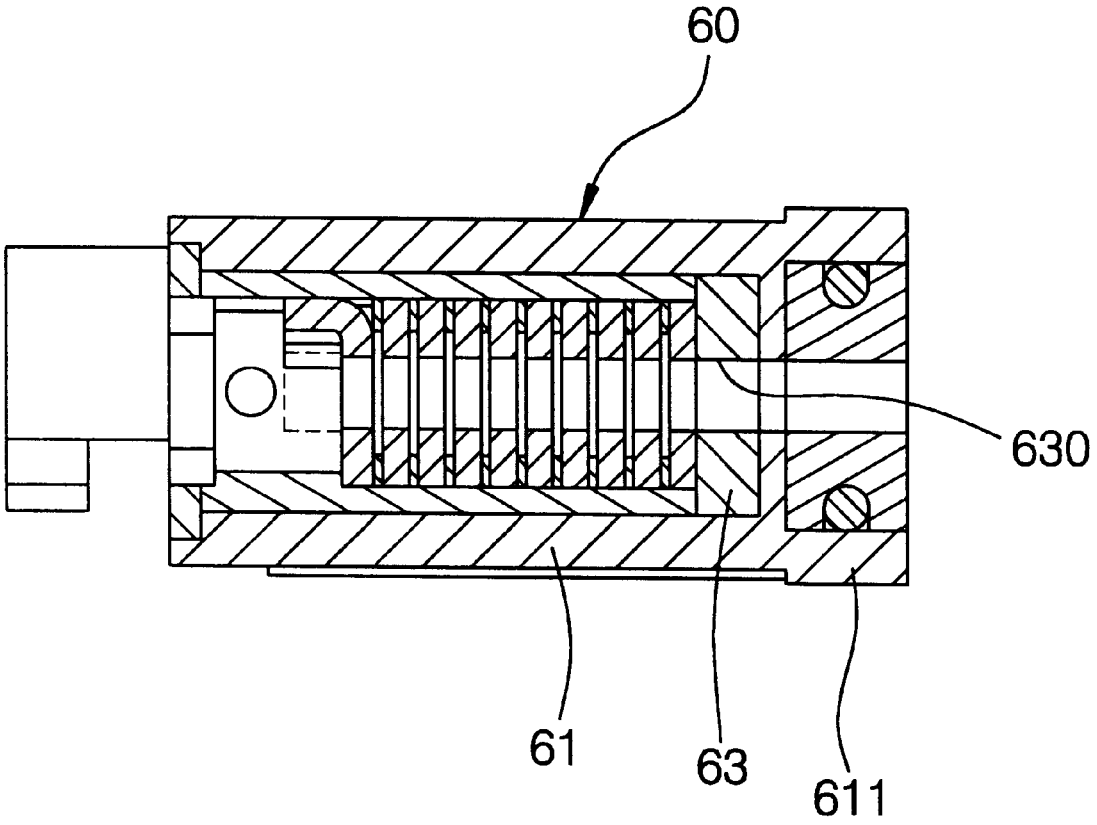
FIG. 8 is a sectional view of the third preferred embodiment of the present invention.

Referring to FIGS. 7 and 8, a third preferred embodiment of the present invention is shown to be similar to the first embodiment except in that another rotary cover member 63 is received in the lock shell 61 between the mounting block 611 and the lock core unit. The rotary cover member 63 is freely rotatable in the lock shell 61 about the axis of the receiving space of the lock shell 61, and has a central key engaging opening 630 that is registered with the key hole of the lock core unit.

With this invention thus explained, it is apparent that numerous modifications and variations can be made without departing from the scope and spirit of this invention. It is therefore intended that this invention be limited only as indicated in the appended claims.

I claim:

1. A lock apparatus comprising:

a lock shell having front and rear end portions and a cylindrical lock core receiving space extending through said front and rear end portions; and a cylindrical lock core unit including a cylindrical inner shell received rotatably in said receiving space of said lock shell, said inner shell having a front chamber and a rear chamber, a stack of annular locking plates disposed rotatably in said front chamber of said inner shell, each of said locking plates having an inner periphery that confines a central hole, said central holes of said locking plates defining cooperatively an axial key hole of said lock core unit, an annular drive plate disposed in said front chamber between said locking plates and said rear chamber of said inner shell, said drive plate having an inner periphery that confines a key passage hole registered with said central hole of said locking plates, and an outer periphery formed with a radial outward drive member that is bent to extend axially into said rear chamber, and a latch actuator having a connecting portion inserted into said receiving space via said rear end portion and further extending into said rear chamber of said inner shell, and an actuating portion that extends from said connecting portion out of said rear chamber, said connecting portion being coupled with said inner shell for co-rotation therewith, said connecting portion having a front end face extending in a transverse direction relative to said key hole, a tubular wall extending from said front end face in a direction toward said front chamber and confining a key insert hole that is registered with said central holes of said locking plates and said key passage hole of said drive plate, and a cam projection extending radially and outwardly from said tubular wall, said cam projection being formed with two planar surfaces at two radial sides of said key insert hole, said front end face, said tubular wall and said planar surfaces of said cam projection cooperatively defining an arc groove, said drive member of said drive plate extending into said arc groove in such a manner that rotation of said drive plate together with said locking plates upon insertion of a correct key into said key hole and said key passage hole will result in movement of said drive member in said arc groove and in abutment of said drive member with one of said planar surfaces to move said latch actuator together with said inner shell between locking and unlocking positions relative to said lock shell.

2. The lock apparatus as defined in claim 1, further comprising:

a mounting block mounted on said front end portion of said lock shell and formed with a central access hole that is registered with said key hole; and a rotary first cover member mounted on said mounting block, said first cover member being fully rotatable in said access hole about axis of said key hole and being formed with a central hole that is registered with said key hole.

3. The lock apparatus as defined in claim 2, wherein said first cover member is made from a high strength metal alloy.

4. The lock apparatus as defined in claim 2, wherein said first cover member has a circular outer periphery that is formed with an annular retention groove therealong, said mounting block having a retention pin that extends chordally into said retention groove such that said first cover member is retained in said access hole and is fully rotatable relative to said mounting block.

5. The lock apparatus as defined in claim 2, wherein said mounting block is formed integrally with said front end portion of said lock shell.

6. The lock apparatus as defined in claim 2, further comprising a rotary second cover member received in said lock shell between said mounting block and said inner shell, said second cover member being freely rotatable in said lock shell about the axis of said key hole and having a central key engaging opening that is registered with said key hole.

7. The lock apparatus as defined in claim 1, further comprising:

a mounting block mounted on said front end portion of said lock shell and formed with an access hole that is registered with said key hole; and a rotary cover member received in said lock shell between said mounting block and said inner shell, said cover member being freely rotatable in said lock shell about the axis of said key hole and having a central key engaging opening that is registered with said key hole.

* * * * *